US011905794B2

(12) United States Patent
Alharbi et al.

(10) Patent No.: US 11,905,794 B2
(45) Date of Patent: Feb. 20, 2024

(54) HYDRAULICALLY DRIVEN ROTATING STRING REAMER AND METHODS

(71) Applicant: Saudi Arabian Oil Company, Dhahran (SA)

(72) Inventors: Salem Alharbi, Dammam (SA); Syed Muhammad Ali, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/744,935

(22) Filed: May 16, 2022

(65) Prior Publication Data

US 2023/0366270 A1 Nov. 16, 2023

(51) Int. Cl.

| | |
|---|---|
| ***E21B 4/20*** | (2006.01) |
| ***E21B 21/00*** | (2006.01) |
| ***E21B 4/02*** | (2006.01) |
| ***E21B 10/26*** | (2006.01) |

(52) U.S. Cl.

CPC ..... *E21B 4/20* (2013.01); *E21B 4/02* (2013.01); *E21B 10/26* (2013.01); *E21B 21/00* (2013.01)

(58) Field of Classification Search

CPC ..... E21B 4/02; E21B 4/20; E21B 10/26

See application file for complete search history.

(56) References Cited

U.S. PATENT DOCUMENTS

| | | | | |
|---|---|---|---|---|
| 3,367,430 | A * | 2/1968 | Rowley | E21B 10/265 175/385 |
| 6,378,626 | B1 * | 4/2002 | Wallace | E21B 4/006 175/269 |
| 7,387,175 | B2 | 6/2008 | Zeer | |
| 7,513,318 | B2 | 4/2009 | Underwood et al. | |
| 7,673,707 | B2 * | 3/2010 | Southard | E21B 4/02 175/57 |
| 10,794,117 | B2 | 10/2020 | Harvey et al. | |
| 2015/0129311 | A1 | 5/2015 | Regener et al. | |
| 2018/0171726 | A1 * | 6/2018 | Donald | E21B 7/24 |

FOREIGN PATENT DOCUMENTS

| | | | | |
|---|---|---|---|---|
| WO | WO-2007133739 | A2 * | 11/2007 | E21B 10/26 |

OTHER PUBLICATIONS

Schlumberger. (2023). Rotary Table. In Schlumberger Energy Glossary, retrieved Mar. 15, 2023 from https://glossary.slb.com/en/terms/r/rotary_table. (Year: 2023).*

* cited by examiner

*Primary Examiner* — Robert E Fuller

(74) *Attorney, Agent, or Firm* — DINSMORE & SHOHL LLP

(57) ABSTRACT

Methods for operating drill strings in a wellbore include providing a drilling apparatus that includes a Kelly drive system for rotating the drill string that includes a bottom hole assembly (BHA) and a Kelly engaged with the Kelly drive system. The BHA includes a hydraulically driven rotating string reamer coupled to the drill string uphole from a drill bit and a near-bit reamer. The hydraulically driven rotating string reamer includes a hydraulic drive operatively coupled to a string reamer. The methods include translating the BHA axially through the wellbore and, while translating the BHA, circulating drilling fluid through the drill string, which causes the hydraulic drive to rotate the string reamer relative to the drill string, drill bit, and near-bit reamer. Rotation of the string reamer by the hydraulic drive reams away imperfections extending radially inward from a wellbore wall of the wellbore.

18 Claims, 5 Drawing Sheets

HYDRAULICALLY DRIVEN ROTATING STRING REAMER AND METHODS

BACKGROUND

Field

The present disclosure relates to natural resource well drilling and hydrocarbon production from subterranean formations, in particular, to bottom hole assemblies with a hydraulically driven rotating string reamer and methods of using the bottom hole assemblies.

Technical Background

Extracting hydrocarbons from subterranean sources often requires drilling a wellbore from the surface to the subterranean geological formation containing the hydrocarbons. The wellbore forms a pathway that permits both fluids and apparatus to traverse between the surface and the subterranean geologic formation. Besides defining the void volume of the wellbore, the wellbore wall also acts as the interface through which fluid can flow from the subterranean formations through which the wellbore traverses to the interior of the well bore. Hydrocarbon producing wellbores extend subsurface and intersect various subterranean formations where hydrocarbons are trapped. The wellbore can contain at least a portion of a fluid conduit that links the interior of the wellbore to the surface. The fluid conduit connecting the interior of the wellbore to the surface can permit regulated fluid flow from the interior of the wellbore to the surface and allow for access between equipment on the surface and the interior of the wellbore.

Specialized drilling techniques and materials are utilized to form the wellbore hole and extract the hydrocarbons from hydrocarbon-bearing subterranean formations. The wellbore is initially formed by operating a drilling apparatus, which includes a drill bit coupled to the downhole end of a drill string, to bore into the earth to form the wellbore. The uphole end of the drill string is engaged with a drilling rig at the surface. The drilling rig typically includes a drive system, such as a Kelly drive or a top drive system, for rotating the drill string in the wellbore. After drilling through each interval, the drill string is removed and a casing string is generally installed and cemented in the interval of the wellbore to stabilize the inner wall of the wellbore and provide fluid isolation between the wellbore and the subterranean formations through which the wellbore passes. Following installation of a casing string, the drill string can then be inserted downhole again to drill the next interval of the wellbore. When the wellbore reaches the hydrocarbon-bearing subterranean formation, the wellbore can be completed for production of hydrocarbons from the hydrocarbon-bearing subterranean formation.

SUMMARY

The present disclosure is directed to bottom hole assemblies for drill strings coupled to and driven by a Kelly drive system at the surface. As previously discussed, during drilling, the drill string is typically rotated by a drive system disposed at the surface. These drive systems can include Kelly drive systems or top drive systems. Kelly drive systems are typically employed for wellbores where the surface has limited location and space. Kelly drive systems can also be used for shallow wells, vertical wells, shallow work-over wells, and wellbores for which the drilling budget is limited. A Kelly drive system is also typically used to optimize the cost of drilling the wellbore since installation of a Kelly drive system is a lot more cost effective compared to a top drive system. One of the main concerns with utilising the Kelly drive system is that back reaming in the open hole of the wellbore is not available. In particular, the drill string cannot be tripped out of the wellbore while the Kelly drive system is rotating the drill string. Instead, the Kelly drive must be stopped and rotation of the drill string ceased before tripping the drill string out of the wellbore. Without rotation, reaming devices that are designed to rotate with rotation of the drill string do not rotate while tripping out of hole and, therefore, are completely ineffective at back reaming the wellbore wall while tripping out of the wellbore.

Reaming during drilling and back reaming while tripping the drill string out of the wellbore help to condition the wellbore wall of the wellbore to reduce or prevent the occurrence of stuck pipe problems. Reaming and back reaming can also condition the wellbore wall in preparation for installing casings in the wellbore. When back reaming is expected, many wellbores that could be drilled and completed at lower cost with a Kelly drive system are converted to more expensive top drive rigs only to keep the option of back reaming while tripping the drill string out of the wellbore.

Accordingly, there is an ongoing need for bottom-hole assemblies (BHA), drilling systems, and methods for drilling wellbores that enable efficient reaming and back reaming in the open hole of the wellbore with a drilling rig comprising a Kelly drive system. The present disclosure is directed to bottom hole assemblies comprising a drill bit coupled to the downhole end of the bottom hole assembly, a near-bit reamer disposed uphole from the drill bit, a drill collar disposed uphole from the near-bit reamer, and a hydraulically driven rotating string reamer coupled to the drill string and disposed uphole from the drill collar. The hydraulically driven rotating string reamer comprises a rotating string reamer operatively coupled to a hydraulic drive that operates to rotate the rotating string reamer independent of the drill string when drilling fluids are circulated through the drill string and through the hydraulic drive.

The bottom hole assemblies of the present disclosure can be used in methods for operating a drill string in a wellbore to drill an interval of the wellbore or to condition the wellbore using a drilling apparatus comprising a Kelly drive system. The methods can include providing the drilling apparatus having a Kelly drive system and making up the drill string comprising the bottom hole assembly of the present disclosure having the hydraulically driven rotating string reamer. The methods include translating the drill string axially through the wellbore while circulating drilling fluids through the drill string. Circulating the drilling fluid through the drill string operates the hydraulically driven rotating string reamer, which reams away features of the wellbore wall extending radially inward into the wellbore cavity. The BHAs of the present disclosure provide the ability to ream and back ream the wellbore while tripping in or tripping out of the wellbore, respectively when using a drilling rig equipped with a Kelly drive system. The ability to back ream while the drill string is not rotating can enable the Kelly drive system to be utilized to reduce the cost of the well drilling operation compared to using a top drive system. The wellbore wall can be conditioned to smooth the wellbore wall with the same drilling BHA to reduce the changes of stuck pipe problems, among other features.

According to a first aspect of the present disclosure, a method for operating a drill string in a wellbore can include providing a drilling apparatus comprising a Kelly drive system for rotating the drill string relative to the wellbore and making up the drill string comprising a bottom hole assembly and a Kelly that engages with a Kelly bushing of the Kelly drive system at a surface of the wellbore. The bottom hole assembly may comprise a drill bit coupled to a downhole end of the bottom hole assembly, a near-bit reamer coupled to the drill string uphole from the drill bit, and a hydraulically driven rotating string reamer. The hydraulically driven rotating string reamer may comprise a rotating string reamer coupled to the drill string uphole from the near-bit reamer and the drill bit and a hydraulic drive operatively coupled to the rotating string reamer. The method may further include translating the bottom hole assembly axially through the wellbore and, while translating the bottom hole assembly axially through the wellbore, producing a flow of drilling fluid through the drill string. The flow of drilling fluid through the drill string may cause the hydraulic drive to rotate the rotating string reamer relative to the drill string, the drill bit, and the near-bit reamer. Rotation of the rotating string reamer relative to the drill string, drill bit, and near-bit reamer may ream away imperfections extending radially inward from a wellbore wall of the wellbore.

A second aspect of the present disclosure may include the first aspect, further comprising reciprocating the drill string axially in the wellbore while producing the flow of the drilling fluid through the drill string, where reciprocating the drill string while producing the flow of drilling fluid through the drill string can cause the hydraulically driven rotating string reamer to remove protruding imperfections from the wellbore wall along at least a portion of the wellbore.

A third aspect of the present disclosure may include either one of the first or second aspects, further comprising translating the drill string axially through the wellbore in an uphole direction without producing the flow of drilling fluid through the drill string, detecting an overpull condition of the drill string while translating the drill string axially through the wellbore, and in response to detecting the overpull condition, circulating the drilling fluid through the drill string to produce the flow of drilling fluid through the drill string. The flow of drilling fluid may cause the hydraulically driven rotating string reamer to rotate relative to the drill string and drill bit to remove at least a portion of protruding imperfections from an inner surface of the wellbore.

A fourth aspect of the present disclosure may include the third aspect, further comprising axially reciprocating the drill string in the wellbore while circulating the drilling fluid through the drill string. Reciprocating the drill string may cause the hydraulically driven rotating string reamer to ream away surface imperfections in the wellbore wall to reduce or eliminate the over pull condition.

A fifth aspect of the present disclosure may include either one of the third or fourth aspects, further comprising ceasing rotation of the drill string by the Kelly drive system before and during translating the drill string axially through the wellbore in an uphole direction.

A sixth aspect of the present disclosure may include any one of the first through fifth aspects, comprising tripping the drill string out of the wellbore and, while tripping the drill string out of the wellbore, circulating drilling fluids through the drill string. Circulating the drilling fluids through the drill string may cause rotation of the hydraulically driven rotating string reamer relative to the drill string, drill bit, and near-bit reamer, and rotation of the hydraulically driven rotating string reamer may back reams the wellbore while tripping the drill string out of the wellbore.

A seventh aspect of the present disclosure may include the sixth aspect, further comprising ceasing rotation of the drill string by the Kelly drive system prior to and during tripping the drill string out of the wellbore.

An eighth aspect of the present disclosure may include any one of the first through seventh aspects, where the near-bit reamer may operate in concert with the drill bit through rotation of the drill string by the Kelly drive system during drilling.

A ninth aspect of the present disclosure may include any one of the first through eighth aspects, where the near-bit reamer and the rotating string reamer may be the same diameter.

A tenth aspect of the present disclosure may include any one of the first through ninth aspects, where the rotating string reamer may have a diameter that is the same as a diameter of the drill bit and the near-bit reamer.

An eleventh aspect of the present disclosure may include any one of the first through tenth aspects, further comprising drilling a new interval of the wellbore by rotating the drill string with the Kelly drive system and circulating drilling fluid through the drill string while translating the drill string axially in a downhole direction. Circulating the drilling fluid through the drill string may cause the hydraulically driven rotating string reamer to rotate relative to the drill string to remove protruding imperfections in the wellbore wall during drilling of the wellbore.

A twelfth aspect of the present disclosure may include the eleventh aspect, where a rotational speed of the rotating string reamer may be the sum of a rotational speed of the hydraulic drive and a rotational speed of the drill string.

A thirteenth aspect of the present disclosure may include either one of the eleventh or twelfth aspects, further comprising upon reaching a total depth of the new interval, cleaning the wellbore by continuing to circulate the drilling fluid through the drill string while maintaining a downhole position of the drill string, ceasing rotation of the drill string by the Kelly drive system, and conditioning the wellbore with the hydraulically driven rotating string reamer.

A fourteenth aspect of the present disclosure may include the thirteenth aspect, where conditioning the wellbore with the hydraulically driven rotating string reamer may comprise circulating the drilling fluids through the drill string, where circulating the drilling fluids through the drill string may produce a flow of drilling fluid that causes the hydraulic drive to rotate the rotating string reamer relative to the drill string, drill bit, and near-bit reamer. The method may further include, while circulating the drilling fluids through the drill string, translating the drill string axially in the wellbore in an uphole direction. Translating the drill string in the uphole direction may translate the hydraulically driven rotating string reamer axially along at least a portion of the new interval of the wellbore. Rotation of the hydraulically driven rotating string reamer relative to the drill string may remove at least a portion of imperfections protruding radially inward from the wellbore wall in the new interval.

A fifteenth aspect of the present disclosure may include either one of the thirteenth or fourteenth aspects, where the rotating of the hydraulically driven rotating string reamer may smooth the inner surface of the wellbore wall in the new interval.

A sixteenth aspect of the present disclosure may include any one of the eleventh through fifteenth aspects, further comprising, after conditioning the wellbore, removing the drill string from the wellbore and installing one or more casing strings in the new interval.

A seventeenth aspect of the present disclosure may include any one of the first through sixteenth aspects, where the drill string is not rotated with the Kelly drive system while translating the drill string axially through the wellbore.

An eighteenth aspect of the present disclosure may include any one of the first through seventeenth aspects, where the drilling fluid circulated through the drill string does not include materials that cause plugging of a hydraulic drive of the hydraulically driven rotating string reamer.

A nineteenth aspect of the present disclosure may include any one of the first through eighteenth aspects, where the drilling fluids comprise solids having average particle sizes of less than or equal to 20 microns.

A twentieth aspect of the present disclosure may include any one of the first through nineteenth aspects, where the drilling fluid may have a concentration of lost circulation materials that does not plug the hydraulic drive of the hydraulically driven rotation string reamer.

A twenty-first aspect of the present disclosure may include any one of the first through twentieth aspects, where the drilling fluid may have a concentration of lost circulation materials less than or equal to 40 pounds per barrel (152 $kg/m^3$).

A twenty-second aspect of the present disclosure may include any one of the first through twenty-first aspects, where the drill string may comprise a drill collar disposed uphole from the near-bit reamer and between the near-bit reamer and the hydraulically driven rotating string reamer.

A twenty-third aspect of the present disclosure may include any one of the first through twenty-second aspects, where the near-bit reamer may be a roller reamer.

A twenty-fourth aspect of the present disclosure may include any one of the first through twenty-third aspects, where the bottom hole assembly may further comprise a drilling jar coupled to the drill string uphole from the hydraulically driven rotating string reamer.

A twenty-fifth aspect of the present disclosure may include any one of the first through twenty-fourth aspects, where the bottom hole assembly may further comprise a crossover subassembly coupled to the drill string uphole from the hydraulically driven rotating string reamer.

A twenty-sixth aspect of the present disclosure may include any one of the first through twenty-fifth aspects, where the wellbore may be a vertical wellbore or a deviated wellbore.

A twenty-seventh aspect of the present disclosure may include any one of the first through twenty-sixth aspects, where the hydraulic drive may rotate the rotating string reamer in a rotational direction that is the same as the direction of rotation of the Kelly drive system.

A twenty-eighth aspect of the present disclosure may include any one of the first through twenty-seventh aspects, where the drill bit and near-bit reamer do not rotate with the hydraulically driven rotating string reamer when drilling fluid is circulated through the drill string.

Additional features and advantages of the technology described in this disclosure will be set forth in the detailed description that follows, and in part will be readily apparent to those skilled in the art from the description or recognized by practicing the technology as described in this disclosure, including the detailed description that follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments of the present disclosure, some embodiments of which are illustrated in the accompanying drawings. Whenever possible, the same reference numerals will be used throughout the drawings to refer to the same or similar parts.

DETAILED DESCRIPTION

Figure 5:
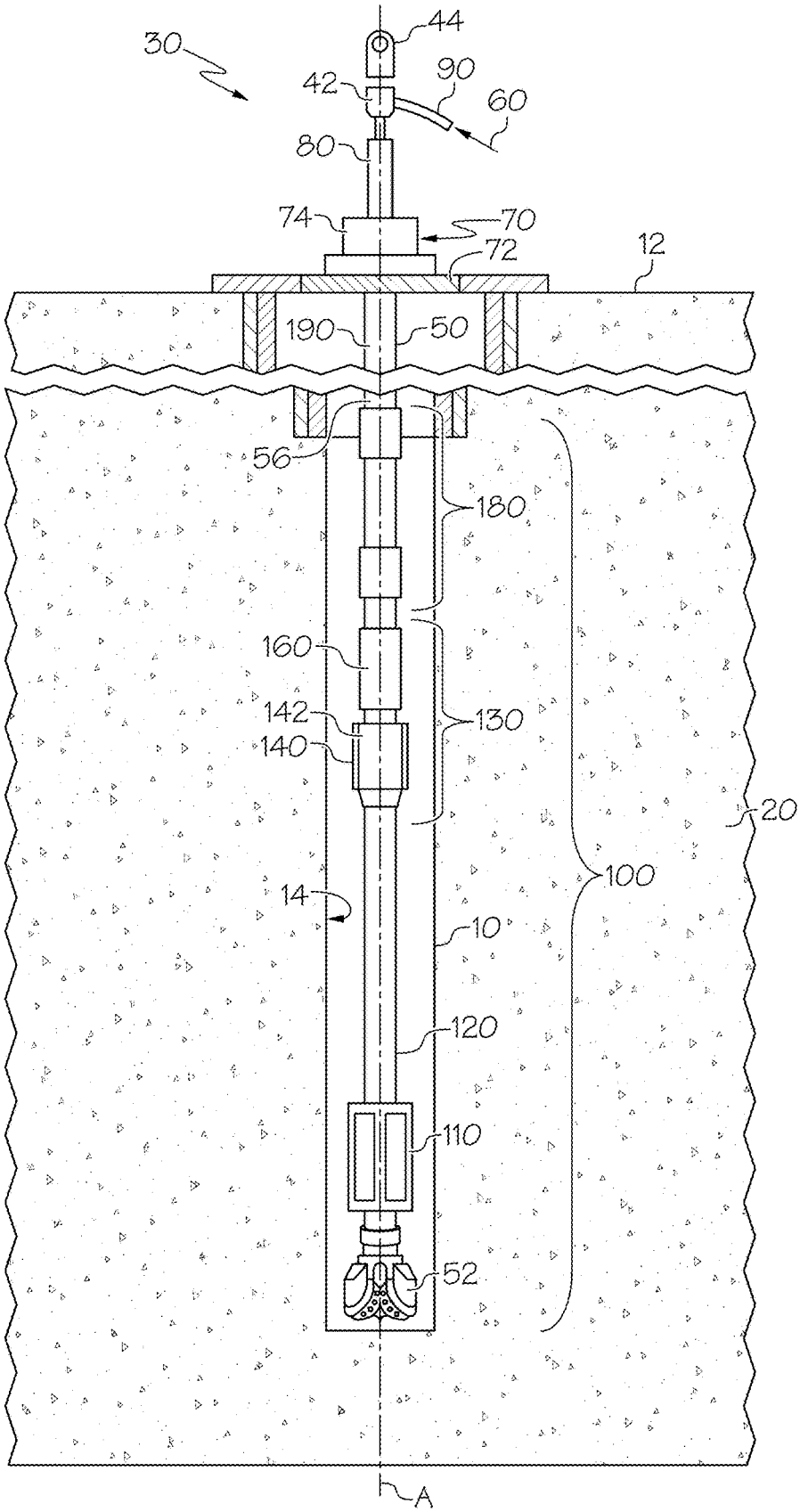
FIG. 5 schematically depicts a drilling apparatus comprising a drill string with a bottom hole assembly, according to one or more embodiments shown and described in this disclosure.

The present disclosure is directed to bottom-hole assemblies that include a hydraulically driven rotating string reamer that can enable back reaming in the open hole of the wellbore when translating the drill string axially through the wellbore with a drilling rig comprising a Kelly drive system. The present disclosure further includes methods of drilling or conditioning a wellbore interval with the bottom hole assembly and Kelly drive system. Referring now to FIG. 5, one embodiment of a drilling apparatus 30 for drilling a wellbore 10 through a subterranean formation and including the bottom-hole assembly 100 of the present disclosure is schematically depicted. The drilling apparatus 30 can include a Kelly drive system 70 and a drill string 50. The drill string 50 can include a Kelly 80 that integrates with the Kelly drive system 70 at the surface 12. The drill string 50 can further include the bottom hole assembly (BHA) 100 coupled to the Kelly 80 through one or a plurality of drill pipe sections 190. The BHA 100 can include a drill bit 52 coupled to a downhole end of the BHA 100, a near-bit reamer 110 coupled to the drill string 50 uphole from the drill bit 52, a drill collar 120 uphole from the near-bit reamer 110, and a hydraulically driven rotating string reamer 130 coupled to the drill string 50 uphole of the near-bit reamer 110, the drill collar 120 or both. The hydraulically driven rotating string reamer 130 can include a rotating string reamer 140 and a hydraulic drive 160 operatively coupled to the rotating string reamer 140, where the hydraulic drive 160 is operable to rotate the rotating string reamer 140 when drilling fluids 60 are circulated through the drill string 50. The drilling apparatus 30 can further include a hoist system 44 coupled to the uphole end of the Kelly 80 and operable to raise and lower the drill string 50 to translate the drill string 50 axially through the wellbore 10.

The BHA 100 can be used in methods of operating the drill string 50 in the wellbore 10. In particular, the BHA 100 of the present disclosure can allow for efficient reaming of the wellbore 10 during drilling and can enable back reaming of the wellbore wall 14 to condition the wellbore wall 14 while tripping the drill string 50 out of the wellbore 10. Methods of operating the drill string 50 in the wellbore 10 can include providing the drilling apparatus 30 with the Kelly drive system 70, making up the drill string 50 comprising the BHA 100 of the present disclosure, and translating the BHA 100 axially through the wellbore in the uphole or downhole directions. While translating the BHA 100 axially through the wellbore, the method can include producing a flow of drilling fluid 60 through the drill string 50, such as by circulating the drilling fluid 60 through the drill string 50 and back up through the annulus defined between the drill string 50 and the wellbore wall 14. The flow of drilling fluid 60 through the drill string 50 causes the hydraulic drive 160 to rotate the rotating string reamer 140 relative to the drill string 50. Rotation of the rotating string reamer 140 relative to the drill string 50 reams away imperfections extending radially inward from the wellbore wall 14 of the wellbore 10.

As used throughout the present disclosure, the term "hydrocarbon-bearing formation" refers to a subterranean geologic region containing hydrocarbons, such as crude oil, hydrocarbon gases, or both, which may be extracted from the subterranean geologic region. The terms "subterranean formation" or just "formation" may refer to a subterranean geologic region that contains hydrocarbons or a subterranean geologic region proximate to a hydrocarbon-bearing formation, such as a subterranean geologic region to be treated for purposes of enhanced oil recovery or reduction of water production or a subterranean geologic region that must be drilled through to get to the hydrocarbon-bearing formation.

As used in the present disclosure, the term "uphole" refers to a direction in a wellbore that is towards the surface. For example, a first component that is uphole relative to a second component is positioned closer to the surface of the wellbore relative to the second component.

As used in the present disclosure, the term "downhole" refers to a direction further into the formation and away from the surface. For example, a first component that is downhole relative to a second component is positioned farther away from the surface of the wellbore relative to the second component. The terms "uphole" and "downhole" are not intended to imply a vertical arrangement but rather are directions along a center axis of the wellbore relative to the surface.

As used throughout the present disclosure, the term "fluid" can include liquids, gases, or both and may include solids in combination with the liquids, gases, or both, such as but not limited to suspended solids in the wellbore fluids; entrained particles in gas produced from the wellbore; drilling fluids comprising weighting agents, lost circulation materials, cuttings, or other solids; or other mixed phase suspensions, slurries and other fluids.

As used in the present disclosure, a fluid passing from a first feature "directly" to a second feature may refer to the fluid passing from the first feature to the second feature without passing or contacting a third feature intervening between the first and second feature.

As used in the present disclosure, the term "tripping" is used to refer to translating the drill string axially through the wellbore and can include full removal of the drill string from the wellbore, running the drill string from the surface into the wellbore, or other translations of the drill string axially through the wellbore. Tripping is not intended to include axial movement of the drill string during drilling, such as the downward translation of the drill string that occurs while operating the drill bit to drill into the subterranean geologic formation.

Figure 1:
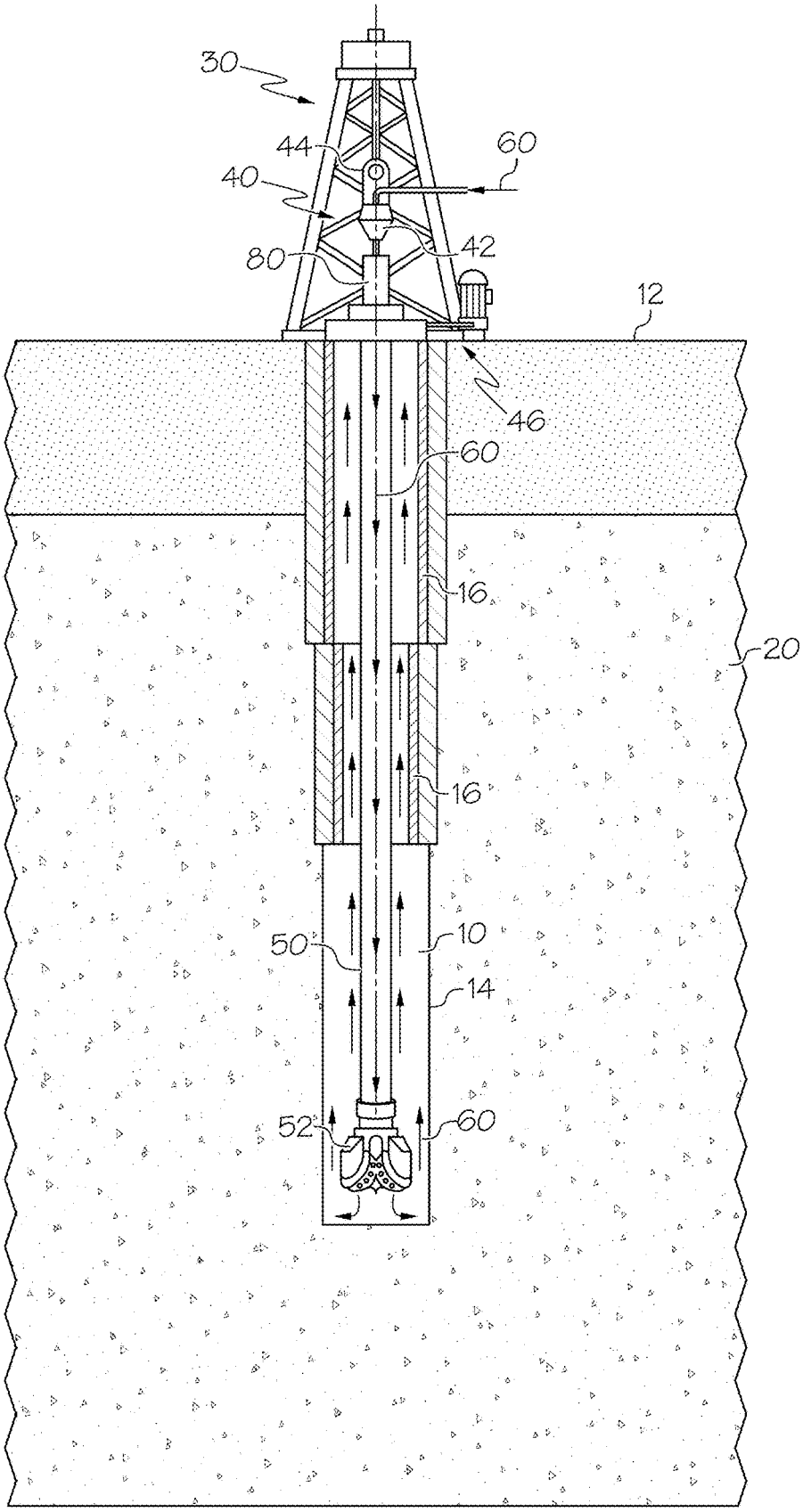
FIG. 1 schematically depicts a drilling apparatus comprising a drilling rig, a drill string, and a drill bit for drilling a wellbore through a subterranean formation, according to one or more embodiments shown and described in this disclosure.

Referring now to FIG. 1, a wellbore 10 extending from the surface 12 into a subterranean formation 20 is schematically depicted. The wellbore 10 forms a pathway capable of permitting both fluids and apparatus to traverse between the surface 12 and the subterranean formation 20, such as a hydrocarbon-bearing subterranean formation. Besides defining the void volume of the wellbore 10, the wellbore wall 14 also acts as an interface through which fluid can transition between the subterranean formation 20 and the interior of the wellbore 10. The wellbore wall 14 can be unlined (that is, bare rock or formation) to permit such interaction with the formation or lined, such as by a tubular casing 16, so as to prevent such interactions. During drilling of the wellbore 10, the portion of the wellbore 10 being drilled is generally unlined until the drill string can be pulled out of the wellbore 10 and the tubular casings 16 can be positioned and cemented in place.

The wellbore 10 may include at least a portion of a fluid conduit that links the interior of the wellbore 10 to the surface 12. The fluid conduit connecting the interior of the wellbore 10 to the surface 12 can be capable of permitting regulated fluid flow from the interior of the wellbore 10 to the surface 12 and can permit access between equipment on the surface 12 and the interior of the wellbore 10. Example equipment connected at the surface 12 to the fluid conduit may include but is not limited to pipelines, tanks, pumps, compressors, and flares. The fluid conduit may be large enough to permit introduction and removal of mechanical devices, including but not limited to tools, drill strings, sensors, instruments, or combinations of these into and out of the interior of the wellbore 10.

Referring again to FIG. 1, a basic drilling apparatus 30 for drilling the wellbore 10 is schematically depicted. The drilling apparatus 30 can include, at the very least, a drilling rig 40, a drill string 50 operatively coupled to the drilling rig 40 and extending downhole into the wellbore 10, and a drill bit 52 coupled to a downhole end of the drill string 50. The drilling rig 40 is used in the present disclosure to refer to the part of the drilling apparatus 30 disposed at the surface 12. The BOP stack and other ancillary equipment is omitted for purposes of clarity. The drill string 50 with the drill bit 52 is disposed downhole, and the drilling rig 40 operates to rotate the drill string 50, thereby rotating the drill bit 52. The drill string 50 generally includes a plurality of interconnected drill pipes extending from the surface 12 down into the wellbore 10 to the drill bit 52. The drill string 50 has a center axis A. In the present disclosure, the axial direction refers to movement of components in an uphole or downhole direction parallel to the center axis A of the drill string 50. The radial direction refers to a direction perpendicular to and outward from the center axis A of the drill string 50.

Rotation of the drill string 50 in combination with the weight of the drill string 50 causes the drill bit 52 to bore into the bottom or downhole end of the wellbore 10 to extend the depth of the wellbore 10 into the subterranean formation 20. While drilling, a drilling fluid 60 is typically circulated through the drill string 50 and the drill bit 52. During operation of the drill bit 52, the drilling fluid 60 is pumped through the inner conduit defined by the interconnected drill pipe of the drill string 50 to the drill bit 52. The drilling fluids 60 flow from the drill string 50, through the drill bit 52, and out into the wellbore 10. The drilling fluids 60 then flow back uphole through the wellbore 10 to the surface 12. In particular, the drilling fluids 60 flow uphole through the annular space defined between the wellbore wall 14 of the wellbore 10 and an outer surface of the drill string 50. Drilling fluids 60 are formulated to have rheological properties that enable the drilling fluids 60 to convey cuttings from the drill bit 52 up to the surface 12. The cuttings, lost circulation materials, and other solids in the returning drilling fluids 60 can also form a mudcake on the wellbore wall 14, which can help to reduce fluid communication between the wellbore 10 and the subterranean formation 20.

Rotation of the drill string 50 in the wellbore 10 and axial movement of the drill string 50 in the uphole and downhole directions during the drilling operation can be controlled by the drilling rig 40 disposed at the surface 12 of the wellbore 10. The drilling rig 40 can include a swivel 42 coupled to the uphole end of the drill string 50, a hoist system 44, and a drive system 46. The swivel 42 may be rigidly secured to an uphole end of the drill string 50, such as an uphole end of the Kelly 80. The other end of the swivel 42 may be coupled to the hoist system 44. The swivel may be operable to allow the drill string 50 to be rotated relative to the hoist system 44. The swivel is not particularly limited and can include any swivel device suitable for coupling to and supporting a drill string in a drilling operation.

The hoist system 44 is coupled to the swivel 42 on the end of the swivel 42 opposite the drill string 50. The hoist system 44 is operable to raise and lower the drill string 50 to translate the drill string 50 and BHA 100 axially through the wellbore 10 in the uphole or downhole directions, respectively. The hoist system 44 is not particularly limited and can include any hoist system 44 suitable for use in drilling operations for drilling wellbores in subterranean formations.

Figure 2:
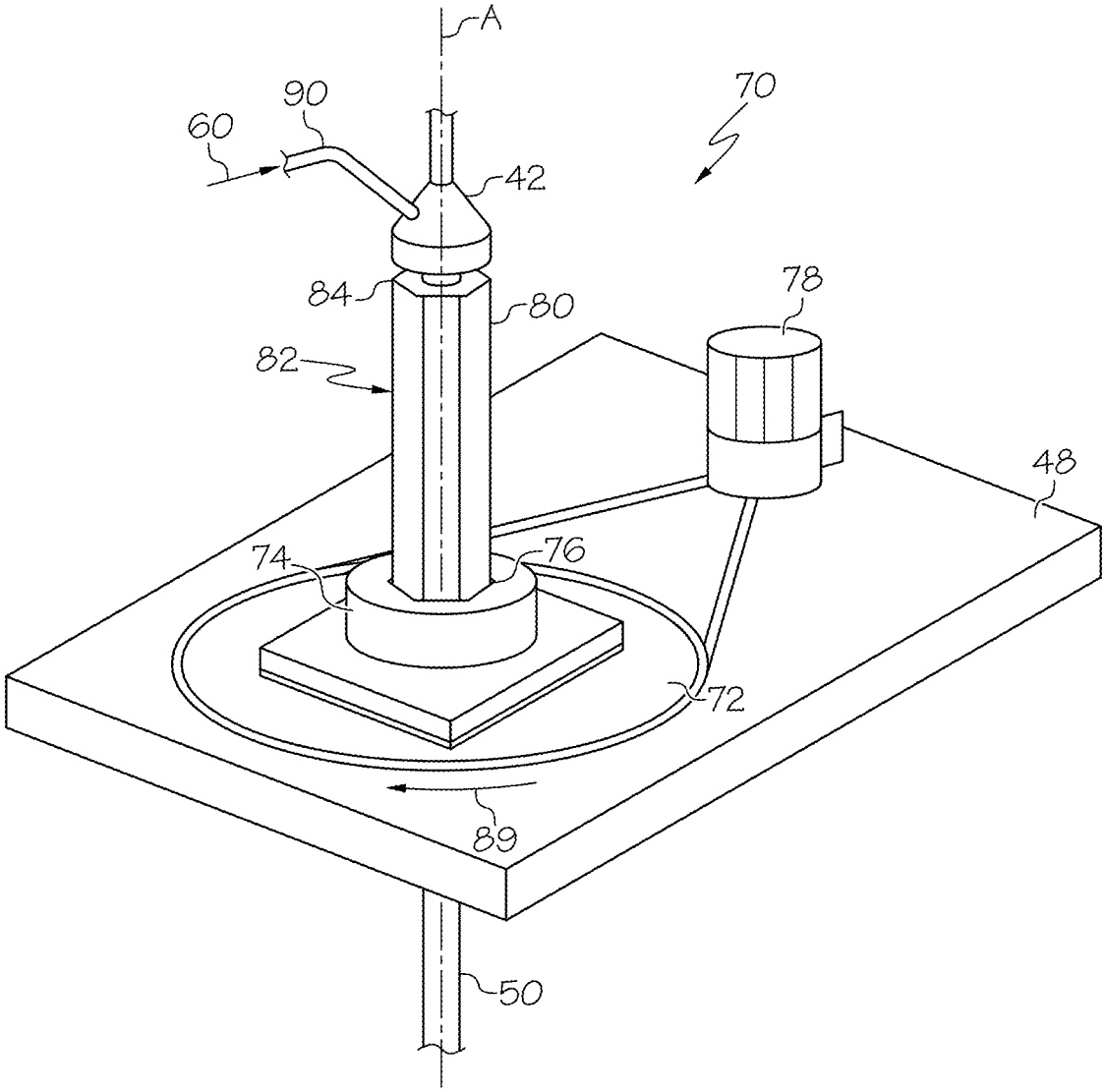
FIG. 2 schematically depicts a Kelly drive system for a drilling apparatus, according to one or more embodiments shown and described in this disclosure.

For the drilling apparatus 30 of the present disclosure, the drive system 46 is a Kelly drive system 70, as shown in FIGS. 1 and 2. As previously discussed, Kelly drive systems 70 can be used where space and/or location is limited. Kelly drive systems 70 can also be used for shallow wells, vertical wells, shallow work-over wells, and wells for which the budget for drilling the wellbore is limited. Kelly drive systems 70 can also be used for reducing the cost of drilling the wellbore 10, since Kelly drive systems 70 are considerably more cost effective compared to top drive systems.

Referring now to FIGS. 1 and 2, the Kelly drive system 70 includes a rotary table 72 comprising a Kelly bushing 74 coupled to the rotary table 72 and a Kelly 80 slidably received in a central bore 76 of the Kelly bushing 74. The rotary table 72 is operatively coupled to a motor 78 by a linkage, such as a drive belt, drive chain, transmission gear system, or other linkage, so that the motor 78 rotates the rotary table 72 relative to a deck 48 of the drilling rig 40. The Kelly bushing 74 can be rigidly connected to the rotary table 72 so that the Kelly bushing 74 rotates with the rotary table 72.

The Kelly 80 comprises a hollow cylinder having an outer surface 82, an upper end 84, a lower end 86, and a bore 88 extending axially though the Kelly 80. The upper end 84 of the Kelly 80 can be secured to the swivel 42 of the drilling rig 40. The lower end 86 of the Kelly 80 is secured to an uphole end of the drill string 50. The bore 88 extends axially through the center of the Kelly 80 and allows drilling fluids 60 and other fluids to pass axially through the Kelly 80 and into the drill string 50. The Kelly drive system 70 can also include a Kelly hose 90 for introducing drilling fluids 60 or other materials into the drill string 50 by way of the bore 88 through the Kelly 80.

Figure 3:
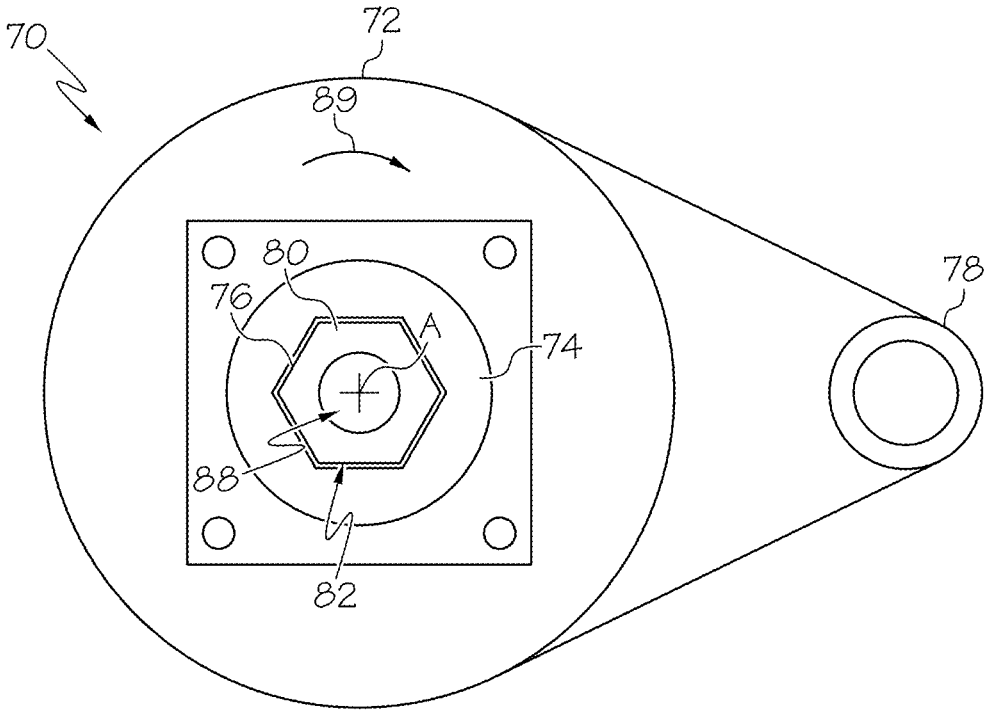
FIG. 3 schematically depicts a top view of the Kelly drive system of FIG. 2, according to one or more embodiments shown and described in this disclosure.
Figure 4:
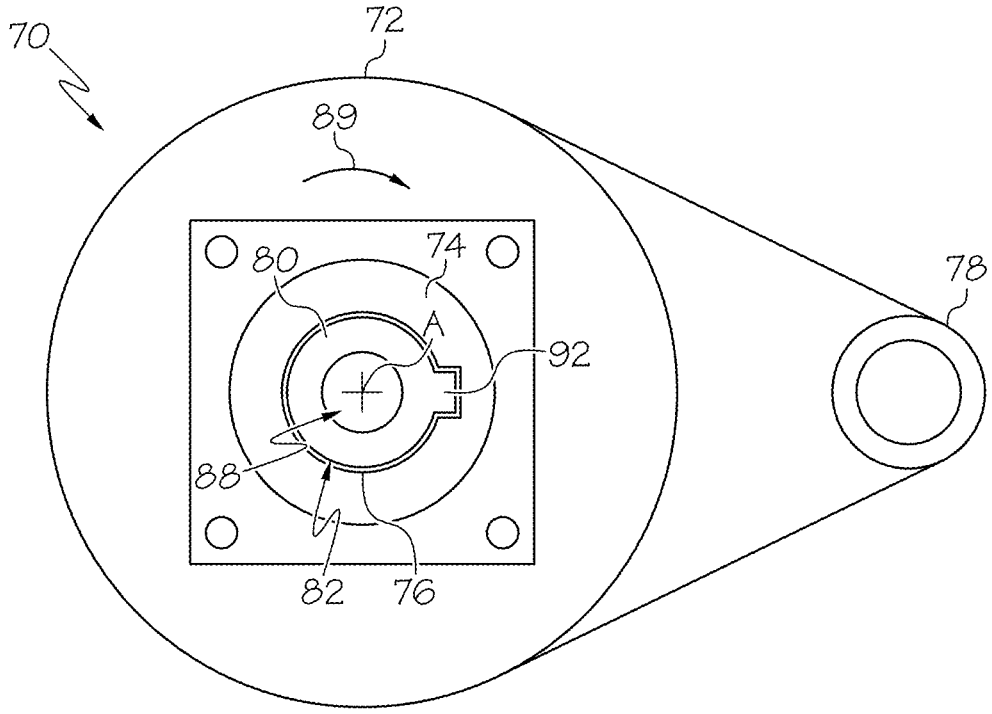
FIG. 4 schematically depicts a top view of another embodiment of a Kelly drive system, according to one or more embodiments shown and described in this disclosure.

Referring now to FIGS. 3 and 4, the outer surface 82 of the Kelly 80 has a non-circular shape, and the central bore 76 of the Kelly bushing 74 has a complimentary cross-sectional shape so that the Kelly 80 can be received through the central bore 76 of the Kelly bushing 74. Referring to FIG. 3, the non-circular shape of the outer surface 82 of the Kelly 80 can be a multi-sided shape, such as a polygonal shape comprising a plurality of sides. The polygon shape can be a regular polygon with sides of all the same length, or can be an irregular polygon with sides of different length. Although shown in FIG. 3 as having a regular hexagon shape having six equal sides, it is understood that the outer surface 82 of the Kelly 80 can have 3 or more sides, such as 3, 4, 5, 6, 7, 8, 9, 10, or more than 10 sides, and the sides can be equal or different in length from one another.

Referring now to FIG. 4, in embodiments, the outer surface 82 of the Kelly 80 can have a cross-sectional shape that is partially circular with a protruding ridge or key 92 extending radially outward from the Kelly 80 and extending axially along the length of the Kelly 80. The key 92 can be received in a corresponding recess 94 in an inner surface of the Kelly bushing 74. In other embodiments, the outer surface 82 of the Kelly 80 can have a recess (not shown) extending axially along the length of the Kelly 80. The recess in the outer surface 82 of the Kelly 80 can receive a corresponding key or ridge (not shown) protruding radially inward from an inner surface of the Kelly bushing 74. In embodiments, the outer surface 82 of the Kelly 80 can have a plurality of keys 92 or a plurality of recesses, which can be angularly spaced around the perimeter of the outer surface 82 of the Kelly 80.

As previously discussed, the central bore 76 of the Kelly bushing 74 has a cross-sectional shape that is complimentary to the cross-sectional shape of the Kelly 80, so that the Kelly 80 can be received through the central bore 76 of the Kelly bushing 74. The non-circular cross-sectional shape of the Kelly 80 provides abutting surfaces that cause the Kelly bushing 74 to rotate the Kelly 80 and the drill string 50 connected thereto when the Kelly bushing 74 is rotated by the rotary table 72. The cross-sectional shape of the Kelly 80 and the central bore 76 of the Kelly bushing 74 interact to prevent rotation of the Kelly 80 relative to the Kelly bushing 74. The Kelly 80 is slidably received through the Kelly bushing 74 so that the Kelly 80 can move in the downhole direction relative to the Kelly bushing 74 during drilling operations.

During operation of the Kelly drive system 70, the Kelly 80 is received in the Kelly bushing 74. The motor 78 is operated to turn the rotary table 72, which in turn rotates the Kelly bushing 74 and the Kelly 80 received through the central bore 76 in the Kelly bushing 74. When drilling, the Kelly drive system 70 may be operated at a rotational speed sufficient for the drill bit 52 to bore into the subterranean formation at the downhole end of the wellbore 10.

During drilling operations, it is often necessary to pull the drill string 50 out of the wellbore 10 and then later run the drill string 50 back into the wellbore 10. As a non-limiting example, at the conclusion of drilling a new interval of the wellbore 10, the drill string 50 is removed from the wellbore 10 and a cementing string is run downhole to install a casing or liner in the new interval. Following installation of the casing, the drill string 50 is then run back into the wellbore 10 to resume drilling the wellbore 10. Other operations, such as but not limited to remediating lost circulation zones, wellbore completion, drill string washout, drill string maintenance, or well logging, can also require removing the drill string 50 from the wellbore 10. Removing the drill string 50 from the wellbore 10 and running the drill string 50 into the wellbore 10 is generally referred to as "tripping."

During tripping the drill string 50 into and out of the wellbore 10, the drill string 50 can often get stuck on obstructions and other features protruding inward from the wellbore wall 14. Stuck pipe problems while tripping the drill string 50 axially through the wellbore 10 can be reduced or eliminated by back reaming the wellbore wall 14 while tripping the drill string 50 axially through the wellbore 10. However, with conventional bottom hole assemblies comprising reaming devices rotated through rotation of the drill string, back reaming requires rotation of the drill string 50 at a rotational speed sufficient for the reaming device to operate effectively to remove surface imperfections from the wellbore wall 14.

When Kelly drive systems 70 are used to rotate the drill string 50 during drilling, back reaming is not available. In particular, the Kelly 80 at the uphole end of the drill string 50 can only be engaged with the Kelly bushing 74 of the Kelly drive system 70 while translating the drill string 50 in a downhole direction. When tripping the drill string 50 in the uphole direction, the Kelly 80 cannot be engaged with the Kelly bushing 74, and the drill string 50 cannot be rotated while tripping the drill string 50 out of the wellbore 10. Rotation of the drill string 50 by the Kelly drive system 70 creates torsional forces between the Kelly bushing 74 and the Kelly 80 that are difficult or impossible to overcome in combination with the weight of the drill string 50 to translate the drill string 50 in the uphole direction. Thus, rotation of the drill string 50 by the Kelly drive system 70 must be ceased before the drill string 50 can be translated axially in the uphole direction. Without the rotation provided by the Kelly drive system 70, conventional reaming devices coupled to the drill string 50 cannot be rotated to back ream the wellbore wall 14 while tripping the drill string 50 uphole or out of the wellbore 10.

Separate and dedicated reaming trips can be performed to condition the wellbore wall 14 and reduce stuck pipe problems when using a Kelly drive system 70. However, dedicated reaming trips require initial removal of the drill string 50 from the wellbore 10 and, therefore, do not reduce stuck pipe problems encountered while initially tripping the drill string 50 out of the wellbore 10 to install the dedicated reaming string. In many cases, when the need for back reaming is anticipated and the drilling location provides enough space at the surface 12, the drilling apparatus is usually converted to a top drive system for rotating the drill string 50, which allows for back reaming but greatly increases the cost of the drilling apparatus. In some cases, space constraints at the surface can preclude installation of a top drive system. Therefore, an ongoing need exists for bottom hole assemblies that can enable back reaming of the wellbore 10 when using the Kelly drive system 70 for rotation of the drill string 50 during drilling operations.

Referring now to FIG. 5, the present disclosure is directed to bottom hole assemblies (BHA) 100 that solve these problems by enabling back reaming while using a drilling rig 40 comprising a Kelly drive system 70. In particular, the BHAs of the present disclosure include a hydraulically driven rotating string reamer 130 that comprises a rotating string reamer 140 and a hydraulic drive 160. The rotating string reamer 140 is coupled to the drill string 50 and at least a portion of the rotating string reamer 140 is rotatable relative to the drill string 50. The hydraulic drive 160 is operatively coupled to the rotating string reamer 140. The hydraulic drive 160 can be operated by circulating drilling fluids 60 through the drill string 50. The hydraulic drive 160 can rotate portions of the rotating string reamer 140, such as a drive shaft 142 and reaming sleeve 150, independent of rotation of the drill string 50 when fluids are circulated through the drill string 50. Independent rotation of the rotating string reamer 140 by the hydraulic drive 160 causes the rotating string reamer 140 to efficiently ream and back ream the wellbore wall 14 while using a drilling rig 40 comprising the Kelly drive system 70, even when the drill string 50 is not rotating while tripping the drill string into or out of the wellbore 10.

The BHAs of the present disclosure provide the option to ream and back ream the interval while tripping in or tripping out of the wellbore, respectively. The ability to back ream while tripping uphole can enable a Kelly drive system to be utilized to reduce the cost of the well drilling operation compared to using a top drive system. The wellbore wall can be conditioned to smooth the wellbore wall with the same drilling BHA to reduce the changes of stuck pipe problems. Thus, the BHAs of the present disclosure can reduce or eliminate stuck pipe problems during translation of the drill string axially through the wellbore when drilling using a drilling rig comprising a Kelly drive system. Additionally, the BHAs disclosed herein can save time during drilling by eliminating the need to run a dedicated reaming assembly downhole. With the BHA of the present disclosure, any interval can be backed reamed to smooth the wellbore wall without disturbing the completed open hole because the hydraulically driven rotating string reamer can be operated independent of rotation of the drill string. In particular, while reciprocating the drill string, only the hydraulically driven rotating stream reamer rotates and the drill bit and near bit reamer are stationary. Further, the hydraulically driven rotating string reamer can be operated during operation of the drill bit to ream the interval while drilling. In this case, the rotations per minute (rpm) of the rotating string reamer will be the sum of the rpm of the hydraulic drive and the surface rpm, which can make the rotating string reamer more efficient at conditioning the wellbore wall, among other features. The hydraulically driven rotating stream reamer can be incorporated into a rotary drilling BHA in a vertical wellbore or incorporated into a dedicated reaming or conditioning BHA in a vertical wellbore or a deviated wellbore, depending on the engineering assessment.

Referring now to FIG. 5, a drilling apparatus 30 comprising the BHA 100 according to the present disclosure is schematically depicted. The drilling apparatus 30 comprises the Kelly drive system 70 and the drill string 50. The drill string 50 includes the Kelly 80 received in the Kelly bushing 74 of the Kelly drive system 70. The drill string 50 further includes the BHA 100 rigidly connected to a downhole end 56 of the drill string 50. The BHA 100 can include the drill bit 52 coupled to the downhole end of the BHA 100, a near-bit reamer 110, and the hydraulically driven rotating string reamer 130. The BHA 100 also can include a drill collar 120 disposed between the near-bit reamer 110 and the hydraulically driven rotating string reamer 130. In embodiments, the BHA 100 can include a drilling jar 180 coupled to the drill string 50, or both.

The drill bit 52 can be coupled to the downhole end of the BHA 100. The drill bit 52 can be any device capable of pulverizing rock in the subterranean formation 20 into small pieces called cuttings to create and extend the wellbore 10. The drill bit 52 can be a tri-cone bit, a polycrystalline diamond compact (PDC) bit, or any other type of drill bit 52 capable of drilling a wellbore 10 through the subterranean formation 20.

The near-bit reamer 110 can be coupled to the drill string 50 proximate to the drill bit 52 and uphole relative to the drill bit 52. In embodiments, the near-bit reamer 110 can be disposed immediately adjacent to the drill bit 52. The near-bit reamer 110 is generally rigidly secured to the drill string 50 so that the near-bit reamer 110 rotates with the drill string 50 and the drill bit 52 at the same rotational speed imparted to the drill string 50 by the Kelly drive system 70. The near-bit reamer 110 can be any type of reaming device capable of reaming the wellbore wall 14 through rotation of the drill string 50 during drilling. In embodiments, the near-bit reamer 110 can be a roller reamer. In embodiments, the near-bit reamer 110 can be the same size as the drill bit 52 so that the near-bit reamer 110 maintains the same hole diameter as the drill bit 52 and does not enlarge the wellbore 10. The size of a reamer or drill bit refers to the diameter of hole produced by the reamer or drill bit. In embodiments, the near-bit reamer 110 can have a larger size (diameter) than the drill bit 52 so that the near-bit reamer 110 under reams the interval during drilling. The near-bit reamer 110 operates in concert with the drill bit 52 through rotation of the drill string 50 by the Kelly drive system 70 to drill the wellbore 10. The rotational speed of the near-bit reamer 110 is the same as the rotational speed of the drill string 50 and the drill bit 52.

The BHA 100 can further include a drill collar 120 disposed uphole from the drill bit 52 and the near-bit reamer 110. The drill collar 120 can be disposed between the near-bit reamer 110 and the hydraulically driven rotating string reamer 130. The drill collar 120 can provide weight to the BHA 100 to produce additional downward gravitational force on the drill bit 52 during drilling.

Referring still to FIG. 5, the hydraulically driven rotating string reamer 130 can include the rotating string reamer 140 and the hydraulic drive 160 operatively coupled to a drive shaft 142 of the rotating string reamer 140. The hydraulically driven rotating string reamer 130 is coupled to the drill string 50 uphole from the near-bit reamer 110 and the drill bit 52. In embodiments, the hydraulically driven rotating string reamer 130 can be spaced apart from the near-bit reamer 110 by the drill collar 120 disposed between the near-bit reamer 110 and the hydraulically driven rotating string reamer 130. The hydraulically driven rotating string reamer 130 can be coupled to the drill string 50 uphole from the near-bit reamer 110, the drill collar 120, or both.

Figure 6:
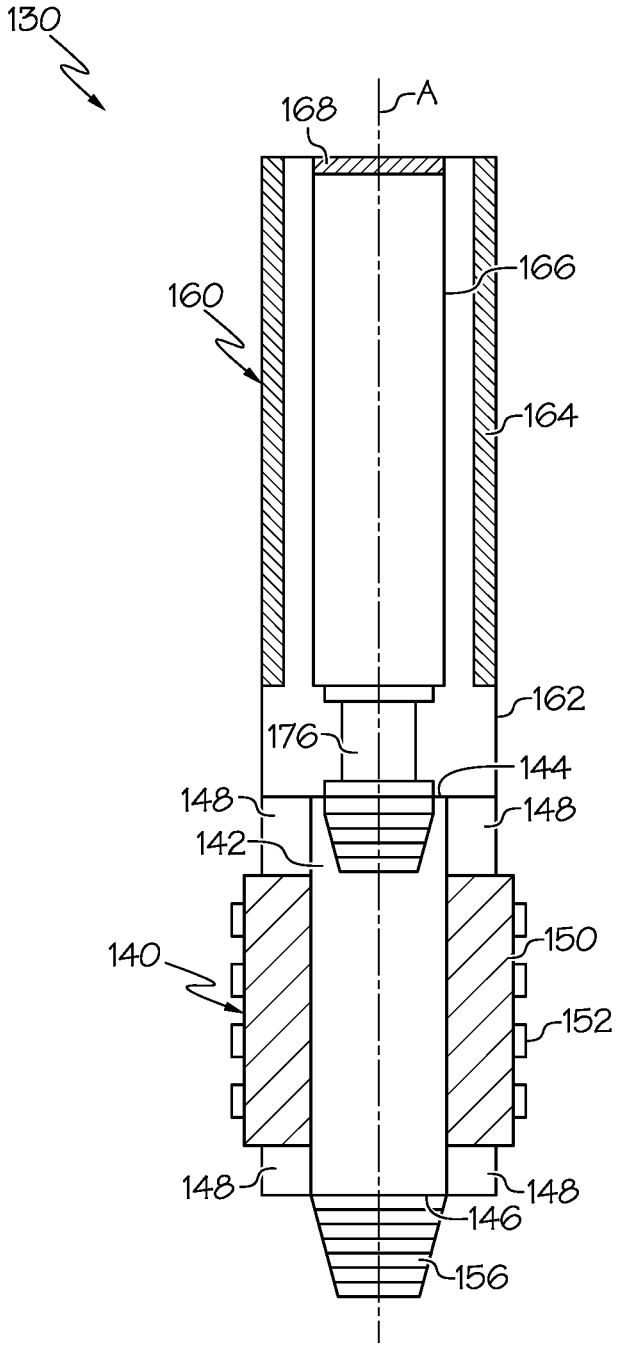
FIG. 6 schematically depicts a hydraulically driven rotating string reamer of the bottom hole assembly depicted in FIG. 5, according to one or more embodiments shown and described in this disclosure.

Referring now to FIG. 6, the rotating string reamer 140 can include a drive shaft 142, one or more bearing assemblies 148, a reamer sleeve 150, and a drill string pin connection 156. The drive shaft 142 is a hollow drive shaft having a central bore extending axially through the drive shaft 142 from an uphole end 144 to a downhole end 146. The central bore of the drive shaft 142 provides a fluid flow path through the rotating string reamer 140 to allow drilling fluids or other materials to pass axially through the rotating string reamer 140. The uphole end 144 of the drive shaft 142 can be rigidly secured to a constant velocity joint 176 that couples the drive shaft 142 of the rotating string reamer 140 to the hydraulic drive 160. Rigidly coupling the drive shaft 142 to the constant velocity joint 176 can cause the drive shaft 142 to rotate with the rotor assembly 166 of the hydraulic drive 160.

The rotating string reamer 140 can include one or a plurality of bearing assemblies 148. The bearing assemblies 148 can stabilize rotation of the drive shaft 142 and provide for smooth rotation of the drive shaft 142 and reamer sleeve 150 relative to the drill string 50. One of the bearing assemblies 148 can be disposed proximate to the uphole end 144 of the drive shaft 142 uphole of the reamer sleeve 150. The rotating string reamer 140 can also include another bearing assembly 148 disposed proximate the downhole end 146 of the drive shaft 142 downhole from the reamer sleeve 150.

The reamer sleeve 150 can be disposed about the drive shaft 142 and can be rigidly secured to the drive shaft 142 so that the reamer sleeve 150 rotates with the drive shaft 142 when the drive shaft 142 is rotated by the hydraulic drive 160. The reamer sleeve 150 can be disposed radially outward from the drive shaft 142 and the drive shaft 142 can extend axially through the reamer sleeve 150. The reamer sleeve 150 can comprise an outer surface comprising a plurality of reaming features 152. The reaming features 152 can include protrusions, such as but not limited to ridges, knobs, blades, helical blades, or other protrusions, that are capable of scraping away or breaking up rock, mudcake, or other imperfections protruding radially inward from the wellbore wall 14. In embodiments, the rotating string reamer 140 can be a roller reamer comprising a rotating drive shaft 142 and a plurality of reaming rollers coupled to the rotating drive shaft 142 or coupled to the reamer sleeve 150. Other types of reaming devices are contemplated for the rotating string reamer 140.

The rotating string reamer 140 can have a size that is the same as a size of the near-bit reamer 110. In particular, the rotating string reamer 140 can have an outer diameter OD of the reamer sleeve 150 that is the same outer diameter of the near-bit reamer 110. In embodiments, the rotating string reamer 140 can be the same size as the near-bit reamer 110 and the drill bit 52. In other words, the reamer sleeve 150 of the rotating string reamer 140 can have an outer diameter OD that is the same as an outer diameter of the near-bit reamer 110 and the drill bit 52. When the rotating string reamer 140 is the same size as the near-bit reamer 110, the rotating string reamer 140 smooths the wellbore wall 14 but does not increase the diameter of the wellbore 10.

The downhole end 146 of the rotating string reamer 140 can include a drill string pin connection 156. The drill string pin connection 156 can couple the rotating string reamer 140 to the drill string 50 while enabling the drive shaft 142 and reamer sleeve 150 to rotate relative to the drill string 50. In embodiments, the drill string pin connection 156 can couple the rotating string reamer 140 to an uphole end of the drill collar 120. Seals may be included between the drive shaft 142 and the drill string pin connection 156, between the drive shaft 142 and the bearing assemblies 148, or both to prevent fluid communication between the interior of the rotating string reamer 140 and the annulus between the drill string 50 and the wellbore wall 14 while circulating drilling fluid through the drill string 50. The seals are omitted from the drawings for clarity purposes.

Referring again to FIG. 6, the hydraulic drive 160 can be disposed uphole of the rotating string reamer 140. The hydraulic drive 160 can include a drive housing 162 rigidly connected to the drill string 50, a stator assembly 164 disposed within the drive housing 162, and a rotor assembly 166 disposed within the stator assembly 164. The rotor assembly 166 can be rotatable relative to the stator assembly 164 and the drive housing 162 so that circulating drilling fluids 60 can rotate the rotor assembly 166 relative to the drill string 50 while the drilling fluids 60 pass through the hydraulic drive 160. The rotor assembly 166 can include a shaft extending axially through the hydraulic drive 160. The shaft can have a shape, such as but not limited to a helical shape, that allows an axially flowing fluid to rotate the shaft of the rotor assembly 166.

The hydraulic drive 160 may further include a rotor catcher 168 rigidly secured to an uphole end of the rotor assembly 166. The rotor catcher 168 can be used to retrieve the rotor assembly 166 in cases in which the drive housing 162 and stator assembly 164 dissociate from the rotor assembly 166 downhole. The hydraulic drive 160 may be operatively coupled to the drive shaft 142 of the rotating string reamer 140 through a constant velocity joint 176. In embodiments, the rotor assembly 166 can be coupled to the constant velocity joint 176 so that rotation of the rotor assembly 166 by the flow of drilling fluid rotates the drive shaft 142 and reamer sleeve 150 of the rotating string reamer 140 relative to the drill string 50 through the linkage provided by the constant velocity joint 176. In embodiments, the hydraulic drive 160 can be configured to rotate the rotating string reamer 140 in the same rotational direction as the direction of rotation of the drill string 50 rotated by the Kelly drive system 70. In embodiments, the hydraulic drive 160 can be a mud motor.

The constant velocity joint 176 can be disposed between the hydraulic drive 160 and the drive shaft 142 of the rotating string reamer 140. The constant velocity joint 176 can be rigidly coupled to a downhole end of the rotor assembly 166 and to the uphole end of the drive shaft 142 of the rotating string reamer 140. The constant velocity joint 176 rotates with the rotation of the hydraulic drive 160 and transfers the rotation to the drive shaft 142 of the rotating string reamer 140. In embodiments, the drive shaft 142 of the rotating string reamer 140 can be directly and rigidly secured to the downhole end of the rotor assembly 166.

The referring again to FIG. 5, the hydraulically driven rotating string reamer 130 can be operated by circulating drilling fluids 60 through the drill string 50. Circulating the drilling fluids 60 through the drill string 50 produces a flow of drilling fluid 60 axially through the conduit formed by the drill string 50 in the downhole direction. The flow of drilling fluid 60 through the drill string 50 causes the hydraulic drive 160 to rotate the rotating string reamer 140 relative to the drill string 50. In particular, the flow of drilling fluid 60 passes over the surfaces of the rotor assembly 166, which causes the rotor assembly 166 to rotate relative to the stator 164 and the drill string 50. Rotation of the rotor assembly 166 of the hydraulic drive 160 can be transferred to the drive shaft 142 of the rotating string reamer 140 through the constant velocity joint 176. The rotation of the drive shaft 142, in turn, rotates the reamer sleeve 150 relative to the drill string 50. The hydraulic drive 160 can rotate the rotating string reamer 140 in a rotational direction that is the same as the direction of rotation of drill string 50 by the Kelly drive system 70. Components of the drill string 50 other than the hydraulically driven rotating string reamer 130, such as the drill bit 52, near-bit reamer 110, drill collar 120, drilling jar 180, or other component, do not rotate with the hydraulically driven rotating string reamer 130 when the drilling fluid 60 is circulated through the drill string 50 and the drill string 50 is not rotated. When the drill string 50 is being rotated by the Kelly drive system 70, the hydraulically driven rotating string reamer 130 rotates at a greater rotational speed compared to the rest of the drill string 50. Rotation of the reamer sleeve 150 relative to the wellbore wall 14 may cause the reamer sleeve 150 and the plurality of reaming features 152 to break up and remove surface imperfections in the wellbore wall 14 to smooth the wellbore wall 14.

In embodiments, the BHA 100 can further include a drilling jar 180 coupled to the drill string 50. When present, the drilling jar 180 can be rigidly secured to the drill string 50 uphole from the hydraulically driven rotating string reamer 130. The drilling jar 180 can be included to assist in dislodging the drill string 50 as a backup in the event the drill string 50 gets stuck in the wellbore 10. The drilling jar 180 can be used to jar the drill string 50 loose. In embodiments, the BHA 100 can further include a crossover subassembly (not shown), which can be incorporated into the BHA 100 uphole from the hydraulically driven rotating string reamer 130, the drilling jar 180, or both. The crossover sub may rigidly secure the BHA 100 to the drill string 50, such as to the sections of drill pipe 190 extending from the BHA 100 to the Kelly 80 coupled to the uphole end of the drill string 50 at the surface 12. The BHA 100 may further include various instruments, sensors, or both for controlling the drilling operation and monitoring the wellbore 10.

The drilling fluid 60 can be any drilling fluid suitable for drilling operations. In embodiments, the drilling fluid 60 pumped into the drill string 50 does not include materials that cause plugging of a hydraulic drive 160 of the hydraulically driven rotating string reamer 130. The drilling fluid 60 described in this paragraph refers to the drilling fluid 60 pumped into the drill string 50 at the surface 12 and does not refer to the drilling fluid as it is returned to the surface 12 through the annulus, because the drilling fluid returned to the surface 12 through the annulus can include cuttings and does not pass through the hydraulically driven rotating string reamer 130. In embodiments, the solids in the drilling fluid 60 pumped into the drill string 50 at the surface 12 can have an average particle diameter of less than or equal to 20 microns (20 micrometers (μm)), such from 5 microns to 20 microns, from 5 microns to 15 microns, from 5 to 6 microns, or even less than or equal to 6 microns. In embodiments, the drilling fluid 60 does not include solids having an average particle size of greater than or equal to 6 microns.

In embodiments, the drilling fluid 60 introduced into the drill string 50 at the surface 12 can include lost circulation materials. The lost circulation materials can be any type of lost circulation material suitable for including in drilling fluids. The lost circulation materials can have an average particle size of less than or equal to 20 microns, such as from 15 microns to 20 microns, or even less than or equal to 15 microns. The drilling fluid 60 introduced into the drill string 50 at the surface 12 can have a concentration of lost circulation materials that does not plug the hydraulic drive 160 of the hydraulically driven rotation string reamer 130. In embodiments, the drilling fluid 60 introduced into the drill string 50 at the surface 12 can have a concentration of lost circulation materials of less than or equal to 40 pounds per barrel (152 kilograms per cubic meter ($kg/m^3$)).

Referring now to FIG. 5, operation of the BHA 100 for drilling an interval of a wellbore will now be described in further detail. Although shown and described herein in the context of a vertical wellbore, it is understood that the BHAs 100 of the present disclosure can be suitable for drilling deviated wellbores, such as but not limited to horizontal wellbores, angled wellbores, or lateral branches. The BHA 100 of the present disclosure comprising the hydraulically driven rotating string reamer 130 can be made up to the drill string 50 at the surface 12. The BHA 100 and drill string 50 are then run into the wellbore 10. The drill string 50 can be operated to drill a new interval of the wellbore 10 by running the drill string 50 into the wellbore 10 until the drill bit 52 is at the bottom or downhole end of the wellbore 10, rotating the drill string 50 with the Kelly drive system 70, and circulating the drilling fluid 60 through the drill string 50. The drill bit 52 and near-bit reamer 110 rotate with the drill string 50 to drill into the subterranean formation and simultaneously ream the wellbore wall 14. The drilling fluid 60 can cool the drill bit 52 and carries cuttings from the bottom of the wellbore 10 to the surface 12 through the annulus defined between the drill string 50 and the wellbore wall 14.

Circulation of the drilling fluid 60 through the drill string 50 further causes the hydraulically driven rotating string reamer 130 to operate to provide additional reaming of the wellbore wall 14. The rotational speed of the hydraulically driven rotating string reamer 130 relative to the wellbore wall 14 can be equal to the sum of the rotational speed of the drill string 50 and the rotational speed imparted by the flow of drilling fluid 60 through the hydraulic drive 160 of the hydraulically driven rotating string reamer 130. Thus, the hydraulically driven rotating string reamer 130 rotates at a rotational speed greater than the rotational speed of the drill bit 52 and near-bit reamer 110. The greater rotational speed of the hydraulically driven rotating string reamer 130 enables the hydraulically driven rotating string reamer 130 to more efficiently ream the wellbore wall 14 during drilling compared to the near-bit reamer 110.

After drilling the new interval, downward translation of the drill string 50 is halted and circulation of the drilling fluid 60 can be continued to clean the wellbore 10 of cuttings from the drilling operation at the new bottom of the wellbore 10. Following clean out of the wellbore 10, the drill string 50 can be tripped out of the wellbore 10. While tripping the drill string 50 out of the wellbore 10, the Kelly drive system 70 is disengaged from the drill string 50 so that the drill string 50 is not rotated. The drilling fluid 60 can be circulated through the drill string 50 while tripping out of the wellbore 10 to operate the hydraulically driven rotating string reamer 130. Operation of the hydraulically driven rotating string reamer 130 back reams the wellbore 10 while tripping the drill string 50 in the uphole direction. Back reaming the wellbore 10 with the hydraulically driven rotating string reamer 130 can condition the wellbore wall 14, which can reduce or prevent stuck pipe problems, prepare the new interval of the wellbore 10 for installation of a casing 16, or both.

The BHAs 100 of the present disclosure can be incorporated into methods of operating the drill string 50 in the wellbore 10. Referring again to FIG. 5, the methods of the present disclosure for operating the drill string 50 in the wellbore 10 can include providing the drilling apparatus 30 comprising the Kelly drive system 70 for rotating the drill string 50 relative to the wellbore 10. The drilling apparatus 30 can include any of the components described herein or otherwise commonly included with a drilling rig comprising a Kelly drive system 70. The methods can include making up the drill string 50 comprising the BHA 100 and the Kelly 80 that engages with the Kelly bushing 74 of the Kelly drive system 70 at the surface 12 of the wellbore 10. The BHA 100 can include the drill bit 52 coupled to the downhole end of the BHA 100, the near-bit reamer 110 coupled to the drill string 50 uphole from the drill bit 52, and the hydraulically driven rotating string reamer 130 disposed uphole from the near-bit reamer 110. The hydraulically driven rotating string reamer 130 comprises the rotating string reamer 140 coupled to the drill string 50 uphole from the near-bit reamer 110 and the drill bit 52. The hydraulically driven rotating string reamer 130 further includes the hydraulic drive 160 operatively coupled to the rotating string reamer 140. The BHA 100 and drill string 50 can be run downhole into the wellbore 10. The BHA 100 and drill string 50 can have any of the features or components previously described herein for the BHA 100 and drill string 50, respectively.

The methods can further include translating the BHA 100 axially through the wellbore 10, such as in an uphole direction or a downhole direction. The methods can further include, while translating the BHA 100 axially through the wellbore 10, producing a flow of the drilling fluid 60 through the drill string 50. The flow of drilling fluid 60 through the drill string 50 causes the hydraulic drive 160 to rotate the rotating string reamer 140 relative to the drill string 50, the drill bit 52, and the near-bit reamer 110. Rotation of the rotating string reamer 140 relative to the drill string 50, drill bit 52, and near-bit reamer 110 reams away imperfections protruding or extending radially inward from the wellbore wall 14 of the wellbore 10. In embodiments, the methods can include ceasing rotation of the drill string 50 by the Kelly drive system 70 before and during translation of the BHA 100 axially through the wellbore 10. In embodiments, the methods can further include reciprocating the drill string 50 axially in the wellbore 10 while producing the flow of the drilling fluid 60 through the drill string 50. Reciprocating the drill string 50 while producing the flow of drilling fluid 60 through the drill string 50 can cause the hydraulically driven rotating string reamer 130 to rotate relative to drill string 50 to remove protruding imperfections from the wellbore wall 14 along at least a portion of the wellbore 10.

In embodiments, the BHA 100 can include the drill collar 120 disposed uphole from the near-bit reamer 110 and between the near-bit reamer 110 and the hydraulically driven rotating string reamer 130. In embodiments, the near-bit reamer 110 can be a roller reamer. The near-bit reamer 110 can operate in concert with the drill bit 52 through rotation of the drill string 50 by the Kelly drive system 70 during drilling to at least partially condition or smooth the wellbore wall 14. In embodiments, BHA 100 can further include the drilling jar 180 coupled to the drill string 50 uphole from the hydraulically driven rotating string reamer 130. In embodiments, the BHA 100 can include the crossover subassembly (not shown) coupled to the drill string 50 uphole from the hydraulically driven rotating string reamer 130. The wellbore 10 can be a vertical wellbore or a deviated wellbore. In embodiments, the drill string 50 is not rotated with the Kelly drive system 70 while translating the drill string 50 axially through the wellbore 10. In embodiments, the drill bit 52 and the near-bit reamer 110 do not rotate with the hydraulically driven rotating string reamer 130 when drilling fluids 60 are circulated through the drill string 50.

In embodiments, the BHA 100 of the present disclosure can be used in a method of back reaming the wellbore 10, such as in a method for conditioning the wellbore 10 to reduce stuck pipe problems, prepare the wellbore wall 14 for installing of a casing 16, or both. The methods can include tripping the drill string 50 out of the wellbore 10 and, while tripping the drill string 50 out of the wellbore 10, circulating drilling fluids 60 through the drill string 50. Circulating the drilling fluids 60 through the drill string 50 can cause rotation of the hydraulically driven rotating string reamer 130 relative to the drill string 50, the drill bit 52, and the near-bit reamer 110. Rotation of the hydraulically driven rotating string reamer 130 back reams the wellbore 10 while tripping the drill string 50 out of the wellbore 10. Back reaming with the hydraulically driven rotating string reamer 130 can condition the wellbore wall 14 to reduce stuck pipe problems, prepare the wellbore wall 14 for installation of a casing 16, or both. While tripping the drill string 50 out of the wellbore 10, the Kelly drive system 70 can be disengaged so that the drill string 50 is not rotated by the Kelly drive system 70 while tripping the drill string 50 out of the wellbore 10. In embodiments, the methods can further include ceasing rotation of the drill string 50 with the Kelly drive system 70 prior to and during tripping the drill string 50 out of the wellbore 10. In embodiments, the methods can include disengaging the Kelly drive system 70 from the drill string 50 before tripping the drill string 50 uphole and out of the wellbore 10.

The methods can include remediating stuck pipe problems in the wellbore. During a stuck pipe incident, the drill string 50, in particular, the drill bit 52, can get hung up on one or more imperfections of the wellbore wall 14 that protrude inward into the wellbore 10. The BHA 100 of the present disclosure can be used to identify and remediate potential stuck pipe problems. While tripping out of hole, if any overpull in the open hole is observed or detected, the Kelly 80 can be connected to the Kelly hose 90 and a pump out operation conducted. A pump out operation comprises circulating a drilling fluid 60 downhole through the drill string 50 and back up to the surface through the annulus between the drill string 50 and wellbore wall 14. While pumping out, the hydraulically driven rotating string reamer 130 can rotate and back ream the interval. In embodiments, the methods can include translating the drill string 50 axially through the wellbore 10 in the uphole direction without producing the flow of drilling fluid 60 through the drill string 50. Translating the drill string 50 in the uphole direction can include operating the hoist system 44 to raise the drill string 50 in the wellbore 10. The methods can further include detecting an overpull condition of the drill string 50 while translating the drill string 50 axially through the wellbore 10. The overpull condition can be detected by known techniques, such as but not limited to monitoring the load on the hoist system 44 or other techniques. The methods can further include, in response to detecting the overpull condition, circulating the drilling fluid 60 through the drill string 50 to produce the flow of drilling fluid 60 through the drill string 50, where the flow of drilling fluid 60 causes the hydraulically driven rotating string reamer 130 to rotate relative to the drill string 50 and drill bit 52 to remove at least a portion of protruding imperfections from the wellbore wall.

In embodiments, the methods can further include axially reciprocating the drill string 50 in the wellbore 10 while circulating the drilling fluid 60 through the drill string 50. Reciprocating the drill string 50 can cause the hydraulically driven rotating string reamer 130 to ream away surface imperfections in the wellbore wall 14 along at least a portion of the wellbore 10 to reduce or eliminate the cause of the over pull condition. In embodiments, the methods can further include ceasing rotation of the drill string 50 with the Kelly drive system 70 prior to and during translation of the drill string 50 axially through the wellbore 10 in the uphole direction without producing the flow of drilling fluid 60 through the drill string 50.

Referring again to FIG. 5, the BHAs 100 of the present disclosure can also be used in methods of drilling the wellbore 10. In particular, the hydraulically driven rotating string reamer 130 can be rotated by circulation of drilling fluid 60 through the drill string 50 during drilling of a new interval of the wellbore 10. As previously discussed, the hydraulically driven rotating string reamer 130 rotates at a greater rotational speed compared to the drill bit 52 and near-bit reamer 110. Thus, the hydraulically driven rotating string reamer 130 can be more efficient at reaming away imperfections in the wellbore wall 14 compared to the near-bit reamer 110. In embodiments, the methods of the present disclosure can include drilling a new interval of the wellbore 10 by rotating the drill string 50 with the Kelly drive system 70 and circulating drilling fluid 60 through the drill string 50. The drill string 50 and BHA 100 translate axially downhole due to the rotation of the drill bit 52 and weight of the drill string 50. Circulation of the drilling fluid 60 through the drill string 50 can cause the hydraulically driven rotating string reamer 130 to rotate relative to the drill string 50 to remove protruding imperfections in the wellbore wall 14 during drilling of the new interval of the wellbore 10.

In embodiments, while circulating drilling fluid 60 through the drill string 50, the hydraulic drive 160 can rotate the rotating string reamer 140 in a rotational direction that is the same as the direction of rotation of the Kelly drive system 70. In embodiments, the rotational speed of the hydraulically driven rotating string reamer 130 is the sum of the rotational speed of the hydraulic drive 160 and the rotational speed of the drill string 50 rotated by the Kelly drive system 70.

In embodiments, the methods of the present disclosure for drilling the wellbore 10 can further include, upon reaching a total depth of the new interval, cleaning the wellbore 10 by continuing to circulate the drilling fluid 60 through the drill string 50 while maintaining a downhole position of the drill string 50, ceasing rotation of the drill string 50 by the Kelly drive system 70, and conditioning the wellbore 10 with the hydraulically driven rotating string reamer 130. Conditioning the wellbore 10 with the hydraulically driven rotating string reamer 130 can include circulating the drilling fluids 60 through the drill string 50, where circulating the drilling fluids 60 through the drill string 50 can produce a flow of drilling fluid 60 that causes the hydraulic drive 160 to rotate the rotating string reamer 140 relative to the drill string 50, drill bit 52, and near-bit reamer 110. Conditioning the wellbore with the hydraulically driven rotating string reamer 130 can further include, while circulating the drilling fluids 60 through the drill string 50, translating the drill string 50 axially in the wellbore 10 in the uphole direction. Translating the drill string 50 in the uphole direction can translate the hydraulically driven rotating string reamer 130 axially along at least a portion of the new interval of the wellbore 10. Rotation of the hydraulically driven rotating string reamer 130 relative to the drill string 50 can back ream the interval to remove at least a portion of imperfections protruding radially inward from the wellbore wall 14 in the new interval to condition the wellbore wall 14. In embodiments, rotating of the hydraulically driven rotating string reamer 130 can back ream the wellbore wall 14 smooth the wellbore wall 14 along at least a portion of the new interval. In other words, conditioning the wellbore 10 can include smoothing the wellbore wall 14 with the hydraulically driven rotating string reamer 130. The methods can further include, after conditioning the wellbore, removing the drill string 50 from the wellbore 10 and installing one or more casing strings in the new interval.

It is noted that one or more of the following claims utilize the terms "where," "wherein," or "in which" as transitional phrases. For the purposes of defining the present technology, it is noted that these terms are introduced in the claims as an open-ended transitional phrase that are used to introduce a recitation of a series of characteristics of the structure and should be interpreted in like manner as the more commonly used open-ended preamble term "comprising."

It should be understood that any two quantitative values assigned to a property may constitute a range of that property, and all combinations of ranges formed from all stated quantitative values of a given property are contemplated in this disclosure.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the claims appended hereto should be taken as the sole representation of the breadth of the present disclosure and the corresponding scope of the various embodiments described in this disclosure. Further, it will be apparent that modifications and variations are possible without departing from the scope of the appended claims.

What is claimed is:

1. A method for operating a drill string in a wellbore, the method comprising:

providing a drilling apparatus comprising a Kelly drive system for rotating the drill string relative to the wellbore;

making up the drill string comprising a bottom hole assembly and a Kelly that engages with a Kelly bushing of the Kelly drive system at a surface of the wellbore, the bottom hole assembly comprising:

a drill bit coupled to a downhole end of the bottom hole assembly;

a near-bit reamer coupled to the drill string uphole from the drill bit; and a hydraulically driven rotating string reamer assembly comprising:

a rotating string reamer coupled to the drill string uphole from the near-bit reamer and the drill bit; and a hydraulic drive disposed uphole of the rotating string reamer, wherein the hydraulic drive is operatively coupled to an uphole end of the rotating string reamer;

translating the bottom hole assembly axially through the wellbore;

while translating the bottom hole assembly axially through the wellbore, producing a flow of drilling fluid through the drill string, where:

the flow of drilling fluid through the drill string causes the hydraulic drive to rotate the rotating string reamer relative to the drill string, the drill bit, and the near-bit reamer; and rotation of the rotating string reamer relative to the drill string, drill bit, and near-bit reamer reams away imperfections extending radially inward from a wellbore wall of the wellbore;

translating the drill string axially through the wellbore in an uphole direction without producing the flow of drilling fluid through the drill string;

detecting an overpull condition of the drill string while translating the drill string axially through the wellbore; and in response to detecting the overpull condition, circulating the drilling fluid through the drill string to produce the flow of drilling fluid through the drill string, where the flow of drilling fluid causes the hydraulically driven rotating string reamer assembly to rotate relative to the drill string and drill bit to remove at least a portion of protruding imperfections from an inner surface of the wellbore.

2. The method of claim 1, further comprising reciprocating the drill string axially in the wellbore while producing the flow of the drilling fluid through the drill string, where reciprocating the drill string while producing the flow of drilling fluid through the drill string causes the hydraulically driven rotating string reamer assembly to remove protruding imperfections from the wellbore wall along at least a portion of the wellbore.

3. The method of claim 1, further comprising axially reciprocating the drill string in the wellbore while circulating the drilling fluid through the drill string, where reciprocating the drill string causes the hydraulically driven rotating string reamer assembly to ream away surface imperfections in the wellbore wall to reduce or eliminate the over pull condition.

4. The method of claim 1, further comprising ceasing rotation of the drill string by the Kelly drive system before and during translating the drill string axially through the wellbore in an uphole direction.

5. The method of claim 1, comprising:

tripping the drill string out of the wellbore; and while tripping the drill string out of the wellbore, circulating drilling fluids through the drill string, where circulating the drilling fluids through the drill string causes rotation of the hydraulically driven rotating string reamer assembly relative to the drill string, drill bit, and near-bit reamer, where rotation of the hydraulically driven rotating string reamer assembly back reams the wellbore while tripping the drill string out of the wellbore.

6. The method of claim 5, further comprising ceasing rotation of the drill string by the Kelly drive system prior to and during tripping the drill string out of the wellbore.

7. The method of claim 1, where the near-bit reamer and the rotating string reamer are the same diameter.

8. The method of claim 1, where the rotating string reamer has a diameter that is the same as a diameter of the drill bit and the near-bit reamer.

9. The method of claim 1, further comprising drilling a new interval of the wellbore by rotating the drill string with the Kelly drive system and circulating drilling fluid through the drill string while translating the drill string axially in a downhole direction, where circulating the drilling fluid through the drill string causes the hydraulically driven rotating string reamer assembly to rotate relative to the drill string to remove protruding imperfections in the wellbore wall during drilling of the wellbore.

10. The method of claim 9, where a rotational speed of the rotating string reamer is the sum of a rotational speed of the hydraulic drive and a rotational speed of the drill string.

11. The method of claim 9, further comprising:

upon reaching a total depth of the new interval, cleaning the wellbore by continuing to circulate the drilling fluid through the drill string while maintaining a downhole position of the drill string;

ceasing rotation of the drill string by the Kelly drive system; and conditioning the wellbore with the hydraulically driven rotating string reamer assembly.

12. The method of claim 11, where conditioning the wellbore with the hydraulically driven rotating string reamer assembly comprises:

circulating the drilling fluids through the drill string, where circulating the drilling fluids through the drill string produces a flow of drilling fluid that causes the hydraulic drive to rotate the rotating string reamer relative to the drill string, drill bit, and near-bit reamer;

while circulating the drilling fluids through the drill string, translating the drill string axially in the wellbore in an uphole direction, where:

translating the drill string in the uphole direction translates the hydraulically driven rotating string reamer assembly axially along at least a portion of the new interval of the wellbore; and rotation of the hydraulically driven rotating string reamer assembly relative to the drill string removes at least a portion of imperfections protruding radially inward from the wellbore wall in the new interval.

13. The method of claim 11, where the rotating of the hydraulically driven rotating string reamer assembly smooths the inner surface of the wellbore wall in the new interval.

14. The method of claim 9, further comprising, after conditioning the wellbore:

removing the drill string from the wellbore; and installing one or more casing strings in the new interval.

15. The method of claim 1, where the drill string is not rotated with the Kelly drive system while translating the drill string axially through the wellbore.

16. The method of claim 1, where the drill string comprises a drill collar disposed uphole from the near-bit reamer and between the near-bit reamer and the hydraulically driven rotating string reamer assembly.

17. The method of claim 1, where the hydraulic drive rotates the rotating string reamer in a rotational direction that is the same as the direction of rotation of the Kelly drive system.

18. The method of claim 1, where the drill bit and near-bit reamer do not rotate with the hydraulically driven rotating string reamer assembly when drilling fluid is circulated through the drill string.

* * * * *